United States Patent [19]

Huber

[11] Patent Number: 4,727,733

[45] Date of Patent: Mar. 1, 1988

[54] WASHING MACHINE

[76] Inventor: Jakob Huber, Les Aveneyeres 8, 1806 St. Légier, Switzerland

[21] Appl. No.: 803,074

[22] Filed: Nov. 29, 1985

[30] Foreign Application Priority Data

Feb. 12, 1985 [CH] Switzerland ..... 615/85

[51] Int. Cl.[4] ..... D06F 21/04; D06F 37/08

[52] U.S. Cl. ..... 68/12 R; 68/17 R; 68/20; 68/27; 68/148; 68/184; 68/207; 68/208

[58] Field of Search ..... 68/12 R, 17 R, 20, 58, 68/27, 140, 143, 148, 152, 181 R, 184, 187, 207, 208, 15, 16; 134/158, 159

[56] References Cited

U.S. PATENT DOCUMENTS

| | | | |
|---|---|---|---|
| 322,710 | 7/1885 | Hargreaves | 68/152 |
| 1,460,400 | 7/1923 | Belknap | 134/158 X |
| 1,869,510 | 8/1932 | Saunders | 68/148 X |
| 2,498,734 | 2/1950 | Bozanich | 68/148 |
| 2,689,413 | 9/1954 | Kachuck | 68/20 X |
| 3,401,834 | 9/1968 | Siegla | 68/17 R X |
| 3,410,117 | 11/1968 | Elam | 68/143 X |
| 3,645,669 | 2/1972 | Rausch | 68/17 R X |
| 4,376,378 | 3/1983 | Svenningsen | 68/16 |

FOREIGN PATENT DOCUMENTS

| | | | |
|---|---|---|---|
| 254791 | 12/1912 | Fed. Rep. of Germany | 68/184 |
| 355079 | 8/1931 | United Kingdom | 68/143 |

*Primary Examiner*—Philip R. Coe

*Attorney, Agent, or Firm*—Werner W. Kleeman

[57] ABSTRACT

The washing machine functions according to a new principle and contains the washable items, particularly washable textiles, in stacked layers in a mesh cage which is fixed in position at a drum rotatably mounted in a casing. Wash water as well as drying air flows through the preferably stationary or slowly rotating drum containing the washable items, is pumped off at an outlet of the casing, and returns again by way of a recirculation pipe to an inlet of the casing. Intermittent rotation of the drum, for example, by 180°, is also possible. In this manner, the wash water or drying air passes through the washable items first from one side and then from the opposite side. All switching procedures are electronically controlled according to a preselected program schedule. The washable items no longer can be damaged by catching on the drum, the wash cycle is more effective and thus shorter than before, and electric energy and chemicals are saved.

32 Claims, 3 Drawing Figures

WASHING MACHINE

BACKGROUND OF THE INVENTION

The invention relates to a new and improved construction of a washing machine for washing washable articles, particularly washable textiles. In its more particular aspects, the present invention specifically relates to a new and improved construction of a washing machine for washing washable articles, particularly washable textile articles, and is constructed to carry out at least one wash and one rinse cycle and, if required, also a spin and drying cycle. A rotatable drum is provided in a casing and holds the articles to be washed. The rotatable drum has passage openings or holes distributed over its circumference for the supply and removal of the wash water with which a detergent is mixed during the wash cycle.

At the present conventional washing machines have a horizontal drum which periodically turns first in one direction and then in the other, whereby the laundry is drawn through the water in the drum. Through this process the laundry is badly squeezed together and even rolled into clumps. The laundry, particularly when it is embroidered, is thereby abraded against the passage openings or holes of the drum and, if such passage openings have sharp edges, can easily cause tears or even holes in the laundry. Accordingly, the so-called gentle-cycle settings with slower drum rotation were introduced. Nevertheless, the danger of clumping of the laundry and of wear and tear still remain. Sometimes to compensate for the slower drum motion, detergents are added in larger quantities or those used have a a higher concentration. However, these conditions are more aggressive towards the laundry and also the environment is increasingly polluted through the waste water.

SUMMARY OF THE INVENTION

Therefore, with the foregoing in mind it is a primary object of the present invention to provide a new and improved construction of a washing machine for washing washable articles or items, particularly textile articles and which is not afflicted with the aforementioned drawbacks and limitations of the prior art constructions heretofore discussed.

Another and more specific object of the present invention is directed to a new and improved construction of a washing machine for washing washable articles or items, particularly washable textile articles, and which prevents to the widest possible extent damage to the washable articles or items during operation of the washing machine.

Still a further significant object of the present invention is directed to a new and improved construction of a washing machine for washing washable articles or items, particularly washable textile articles, and which permits the washing of delicate and even breakable articles.

Another, still important object of the present invention is directed to a new and improved construction of a washing machine for washing washable articles or items, particularly washable textile articles, and which requires lesser amounts of detergents and shortened wash and rinse cycles with a corresponding saving of energy consumption and yet ensures a thorough and complete washing operation on the washable articles or items placed into the washing machine.

Now in order to implement these and still further objects of the invention, which will become more readily apparent as the description proceeds, the washing machine of the present development is manifested by the features that, a drum is provided in which the washable articles remain stationary, i.e. are held in place in the drum during either continuous rotation of the drum or intermittent rotation of the drum by a maximum rotational angle of about 180°. Means are provided for continuously flowing wash water or liquid through the drum in a direction at least approximately normal to the axis of the drum. Recirculation means including a pump and a recirculation conduit are installed between an inlet and an outlet of a casing which surrounds the rotatable drum and particularly serve for recycling the wash water or liquid during the wash and rinse cycles of the operation of the washing machine.

The inventive washing machine permits carrying out a new and improved washing process or operation during which the laundry is held stationary or fast in the drum through which wash water flows during the entire wash and rinse cycles of the operation of the washing machine. Clumping of the laundry is prevented and at the same time the washable articles or laundry is cleaned more uniformly and thus more quickly. In this manner less detergent is required and the time for the entire wash cycle and the corresponding energy consumption and expendicture are decreased. Furthermore, the wear and tear of the laundry is avoided which makes possible the washing of delicate and even breakable items. By rotating the drum, during the wash and/or rinse cycle, by 180° from time to time, the wash water reaches the articles or items to be cleaned once from one side and the next time from an other side, which also improves and shortens the wash and rinse cycles. The construction may be such as to enable a spin and/or drying cycle to follow the wash cycle. All switching and dosing processes are electronically controlled and adjustable by a selected time program or program schedule.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that only enough of the construction of the washing machine has been shown as needed for those skilled in the art to readily understand the underlying principles and concepts of the present development, while simplifying the showing of the drawings. Turning attention now specifically to FIG. 1 of the drawings, the washing machine illustrated therein by way of example and not limitation will be seen to contain a housing 11.

Figure 1:
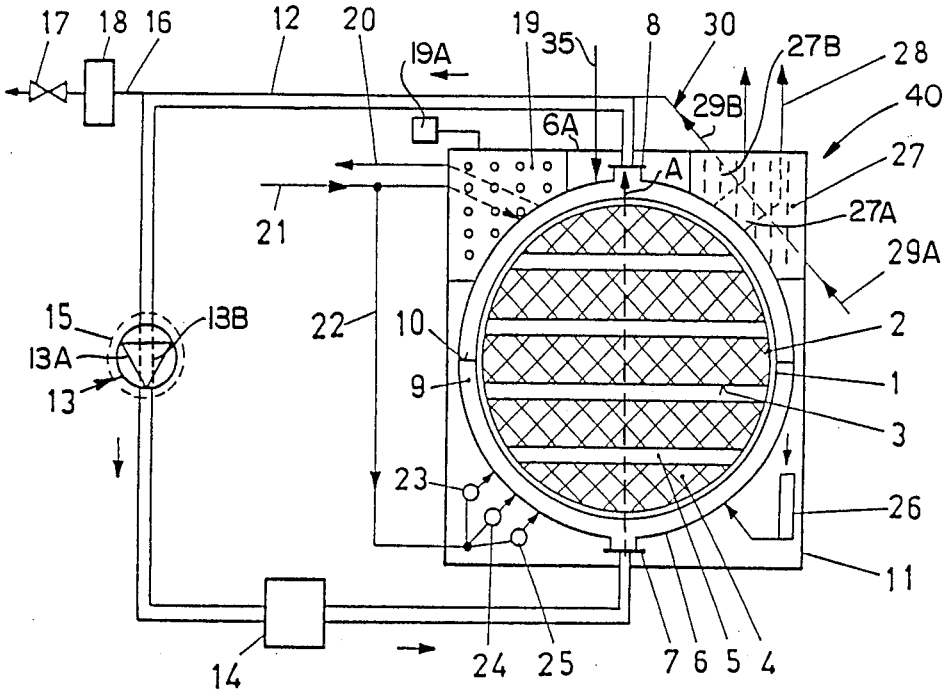
FIG. 1 is a schematic and diagrammatic illustration of an exemplary embodiment of the inventive washing machine.

As a matter of clarification it is mentioned here that individual components and most of the connections in such washing machine have been shown in FIG. 1 outside the housing 11 for the purpose of clearer representation. However, in reality, the exemplary embodiment of the inventive washing machine forms an integrated, compact unit in which the components and most of the connections are arranged within the housing 11. For the same reasons of clarity, there have not been shown the different valves which govern the various fluid-carrying lines or conduits provided in the housing 11.

A mesh cage 2 is located in a substantially cylindrical drum 1 and fastened therein in any appropriate manner. The mesh cage 2 is subdivided by mesh divider walls 3 such that there occur layers 4 which are filled with washable articles or items, particularly washable textile articles or laundry, and which extend substantially parallel to each other and to the drum axis 1A of the drum 1. Between each layer 4 there is an open space 5 free of washable articles or items or laundry as clearly seen in FIG. 2. The drum axis 1A can be directed substantially horizontal or substantially vertical and thus the drum 1 conjointly with the mesh cage 2 can be substantially horizontally or substantially vertically arranged.

The drum 1 is surrounded in a spaced relationship by a water- and air-tight casing 6 having a inlet 7 and an outlet 8. An open or intermediate space 9 between the drum 1 and the casing 6 is divided by partitions or walls 10. The entire washing machine is surrounded by the housing 11.

Recirculation means 12, 13 comprise a recirculation pump 13 and a recirculation conduit or pipe 12 which extends from the outlet 8 to the inlet 7 of the casing 6. The recirculation pump 13 and a heater 14, e.g. an electrical or gas-fired heat exchanger, are connected in the recirculation conduit 12. An additional heater 15 is installed in a housing 13A of the recirculation pump 13, preferably around its throughflow channel 13B, and is in the form of a coil or rods which can be equally well heated by gas or electrically.

A drain pipe 16 branches off from the recirculation conduit or pipe 12 and is fitted with a relief or drain valve 17 which is preceded by a coarse filter 18 as seen in the throughflow direction.

In the corners between the casing 6 and the housing 11 there is sufficient space to incorporate all other components and auxiliary devices of the inventive washing machine. A heat exchanger 19 also functions as a boiler and therefore can be heated either electrically or with gas by external heating means 19A. On one side waste water or washing liquid flow into the heat exchanger 19 from the casing 6 and flows out through an outlet pipe 20. On the other side, fresh water comes from a supply line or fresh water feed pipe 21 and flows into the heat exchanger 19 and therein is in heat exchange relationship with the waste water or washing liquid which entered the heat exchanger 19 from the casing 6. A pipe 22 branches off from the fresh water supply line or feed pipe 21 and leads to dispensers or containers 23, 24, 25 for powdered detergent. A container 26 for liquid detergent can be additionally provided if required or desired.

Drying means 30 contain warm air generating means 40 which comprise a further heat exchanger 27. Exhaust or warm air from the casing 6 is partially or totally passed through the further heat exchanger 27 to the surrounding atmosphere as indicated by the arrows 28. Fresh air inlet means 29A are connected to one side of the further heat exchanger 27 which thus provides heat exchange between the fresh air infed through the fresh air inlet means 29A, and the exhaust or warm air which has passed through the washable articles or items contained in the mesh cage 2 during a drying operation. The further heat exchanger 27 may contain a cooling section 27A in which water vapors are condensed from the exhaust or warm air, and a heating section 27B which is series arranged to the cooling section 27A and produces warm air at warm air outlet means 29B arranged on an other side of the further heat exchanger 27. The heating section 27B is heated by appropriately selected external heating means. The warm air outlet means 29B is connected to a recirculation pipe for recirculating the air in a substantially closed system, in the illustrated embodiment to the recirculation conduit or pipe 12 of the recirculation means 12, 13.

Figure 2:
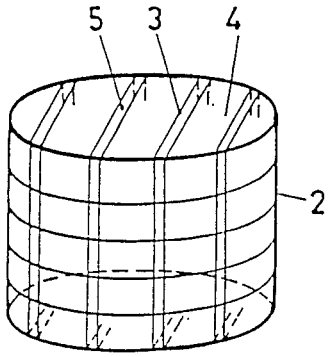
FIG. 2 is a perspective view of a mesh cage for holding the washable articles or items in the washing machine shown in FIG. 1.

The empty mesh cage 2 is shown in a perspective view in FIG. 2. The parallel layers 4 for holding the washable articles or items and formed by the mesh divider walls 3 with the open spaces 5 therebetween, are easily recognizable. Depending upon the washable articles or items to be washed, the mesh cage 2 may have either more or fewer mesh divider wall 3 and, if desired, no open spaces therebetween at all. As viewed in the drawing, the washable articles or items are put in from above and this can be accomplished either in the assembled state with the drum 1 and the mesh cage 2 inside the casing 6 or with the mesh cage 2 outside the washing machine.

Figure 3:
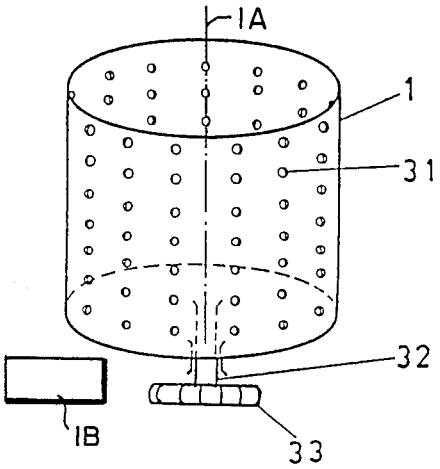
FIG. 3 is a perspective view of a rotatable drum and its associated rotary drive means in the washing machine shown in FIG. 1.

FIG. 3 shows the drum 1 with the circumferentially distributed passage openings 31 for the infeed and outfeed of wash water or washing liquid and warm or drying air.

As already described with reference to FIG. 1, the mesh cage 2 is placed into the drum 1 and fastened thereto. Rotary drive means 1B comprise an impeller 33 mounted on a stub shaft 32 which is rotatably supported by means of bearings on one side of the drum 1. Instead of an impeller, guide vanes can be mounted directly at the drum. The initiation of rotation of the drum 1 will be explained further hereinbelow. Of course, depending on the construction of the washing machine, the drum 1 may have bearings on both sides.

The entire wash process or operation is carried out as follows; all switching procedures are controlled in conventional or customary manner through a selected electronic time program or program schedule either together or integrated into groups:

After filling the mesh cage 2 with the washable articles or items, particularly washable textile articles or laundry, clean or fresh water for a prewash cycle is filled into the casing 6 through the supply line or fresh water feed pipe 21 and the heat exchanger 19 until a predetermined water level is reached and a conventional and therefore not particularly illustrated level regulator shuts off the infeed of the clean or fresh water. The heat exchanger 19 remains filled with the infed clean or fresh water either by means of a check valve or by an overflow at the highest point.

During the same time during which the casing 6 and the heat exchanger 19 are filled with clean or fresh water, powdered detergent is flushed in from a container or detergent dispenser 23 or, if the washing machine is equipped with such a device, liquid detergent is injected from a container or liquid detergent dispenser 26. This can be accomplished either electrically, mechanically or hydraulically.

After completion of the filling process, the recirculation pump 13 is activated for a prewash cycle and pumps wash water or liquid from the outlet 8 through the recirculation pipe 12 to the inlet 7 of the casing 6. Heating of the wash water or liquid would be clearly possible along this flow path, but is not customary and usually also not necessary. The recirculating wash water or liquid which flows in at the inlet 7, is distributed throughout the open or interrmediate space 9 between the drum 1 and the casing 6 and flows through the washable articles or items to the outlet 8. The partitions or walls 10 are provided so that the wash water or liquid does not flow out by the shortest possible path through the open or intermediate space 9 to the outlet 8 thereby by-passing the washable articles or items. During this prewash cycle as well as throughout all the subsequent cycles of the entire washing process or operation, the washable articles or items in the mesh cage 2 do not move relative to the drum 1 and the wash water or liquid flows through such washable articles.

The rotary drive means 1B for rotating the drum 1 is switched on simultaneously with the activation of the recirculation pump 13. The rotation may be continuous, preferably slow in order to protect the washable articles or items, to save energy, and to give the wash water or liquid time to flow thoroughly through the washable articles or items. Another advantageous possibility is to rotate the drum only intermittently with longer pauses in between. It is most useful to set or arrange the drum 1 such that the layers 4 of washable articles or items are opposed to the general direction of the wash water or liquid flow through the drum 1. After a preprogrammed period of time the drum 1 is rotated by 180° so that the wash water or liquid now passes through the washable articles or items from the opposite side. This procedure may be repeated as often as desired. The result is an excellent cleaning effect already during the prewash cycle of the washing process or operation.

After completion of the aforedescribed prewash cycle, the dirty water or used wash water or liquid is drained, with the recirculation pump 13 shut off, by way of the recirculation pipe 12 into the drain pipe 16. The coarse filter 18 protects the relief or drain valve 17 and is provided to collect larger pieces of dirt which have possibly been carried along and otherwise would clog or even damage the relief or drain valve 18.

Subsequently, the thus prewashed articles or items, especially laundry or textile articles, could undergo a spin cycle in order to eliminate as much of the dirty water or used wash water or liquid as possible. For this process the drum 1 must rotate much faster than during the prewash cycle. Of course, the rotary means therefore could comprise a small motor, however, other methods suggest themselves, particulary available hydraulic rotary drive means, whereby a motor can be dispensed with. To exploit this possibility, the impeller 33 connected with the drum 1, for example, is impinged upon by pressurized water or used wash water or liquid. A remainder of the dirty water in the casing 6 is sufficient for this purpose, wherefore the recirculation pump 13 is reactivated so that the rotary drive means 1B direct a driving jet onto the impeller 33. For fast rotation, the full pressure is utilized whereas for slower rotation the liquid supply to the rotary means 1B or the impeller 33 is throttled. An external water supply could also be used for this purpose, if there is available an adequate quantity under sufficiently high pressure.

During the prewash cycle as well as during subsequent spin cycles, which are provided if desired, the clean water in the heat exchanger 19, which thereby functions as a boiler, is heated by the separate heater or external heating means 19A. For a subsequent wash cycle, only warm water from the heat exchanger 19 is passed into the casing 6 until shut-off by the level regulator. At the same time, detergent powder is flushed in from the container or detergent dispenser 24 through the pipe 22 branching off from the fresh water supply line or feed pipe 21, or injected from the container or liquid detergent dispenser container 26.

The recirculation pump 13 and the rotary drive means 1B for rotating the drum 1 are then switched on. As was the case during the prewash cycle, the rotatable drum 1 can be continuously rotated or intermittently rotated by 180°.

The recirculation pump 13 draws wash water or liquid from the outlet 8 of the casing 6 and, by way of the recirculation pipe 12, pumps it back through the inlet 7 into the casing 6 where it flows through the washable articles or items and is drawn off again through the outlet 8. During passage through the recirculation conduit or pipe 12 the wash water or liquid is heated to the desired temperature, either by means of the heater 14 or, depending upon the type of heating intended by means of the additional heater 15 associated with the recirculation pump 13. The wash water or liquid also is maintained at this desired temperature during the wash cycle.

The degree of soiling of the washable articles or items determines the actual and continuous detergent consumption, i.e. the continuous decrease in the concentration of detergent in the wash water or liquid during the course of the wash cycle. Based upon this fact, it is possible to determine, for various types of washable articles or items, particularly textile articles or laundry and differing degrees of soiling, curves of the ideal value for the necessary concentration of detergent in a particular case and program these curves are into the washing machine. These curves plotted against time and show a decreasing trend toward zero.

At preprogrammed time intervals the actual value of the detergent concentration in the wash water or liquid is measured. This can be accomplished, in a well-known manner, for example, using two electrodes which function as sensors, and comparing at each time the measured value with the specified ideal value. The ideal value can be reached, for example, by the addition of more detergent and therefore the liquid detergent dispenser 26 is particularly suitable. As the curve tends toward zero during the wash cycle and the described procedure, practically the entire quantity of detergent is used up. The wash cycle is completed when the specified time of the specifically selected curve has run out or the measured or actual value exceeds the specified ideal value after a predetermined minimum time of the wash cycle.

The addition of detergent can also be regulated in a different manner. The actual value of the concentration is measured from time to time and through the addition of detergent brought to a constant ideal value. As soon as the difference between the ideal value and the actual value falls below a predetermined minimum, the wash cycle is stopped.

The consumption of detergent in the latter case is certainly somewhat greater than in the former. Still considerably less detergent is used than customary hitherto, when a constant amount was generally used which often tended to be greater than necessary in order to obtain reliably clean laundry or washable articles.

Using the inventive washing machine, the washable articles or items are treated more carefully and at less impact on the enviroment. A combination of the two types of controls just described is also conceivable.

To prevent the wash water or liquid from becoming too much soiled or dirty during the wash cycle, a limited amount of wash water or liquid can be drained off at intervals or continusouly and replaced by fresh water from the heat exchanger 19. The waste water or liquid can be drained through the drain pipe 16 but it is more economical to pass the waste water or liquid through the heat exchanger 19 for transferring heat to the infed fresh water and to then drain the waste water or liquid through the outlet pipe 20.

After completion of the wash cycle, the entire waste water or liquid is drained off preferably through the heat exchanger 19 in order to at least partially use the heat content of the waste water or liquid. To give the heat exchanger sufficient time, the waste water or liquid is drained off preferably slowly which can be accomplished using additional valves or a small centrifugal pump. The washable articles or items can also be spun substantially in the manner as described hereinbefore prior to the start of the rinse cycle to be described hereinafter.

The rinse cycle proceeds in a manner similar to the aforedescribed wash cycle. Fresh water is heated by the waste water or liquid previously passed into the heat exchanger 19 and possibly also by the external heating means 19A and enters the casting 6 as rinse water from the heat exchanger 19. A level regulator controls the amount of fresh water flowing in, stops the infeed and transmits a pulse for activating the recirculation pump 13. This recirculation pump 13 forces the rinse water through the washable articles or items, pumps it off at the outlet 8 and, by way of the recirculation conduit or pipe 12, pumps it through the inlet 7 back into the casing 6. During this operation, the rinse water may be further heated by the heaters 14 or 15; however, depending upon the washable articles or items washed, minimally heated or even cold rinse water would be adequate.

At the beginning of the rinse cycle, the rotatable drum 13 is also positioned such that the layer 4 of washable articles or items are opposed to the general flow direction through the rotatable drum 1. From time to time the drum 1 is rotated through 180° so that the rinse water flows from opposite sides into the layers 4. Also, an occasional rotation of the drum 1 only 90° for allowing direct flow of rinse water through the open spaces 5, can sometimes be useful. An additional infeed of rinse water through an additional infeed pipe 35 close to the highest point 6A of the casing 6 can further increase the rinsing effect.

The rinse cycle is stopped after a preprogrammed time period. It is, however, possible to measure the remaining concentration of detergent and, if necessary, drain off the used rinse water and start a further rinse cycle. It is often useful to add a softening agent from a container 25 to the rinse water during the last rinse cycle. Also, an intermediate spin cycle is possible and increases the rinsing effect. Accordingly, the washable articles or items are completely clean and chemical-free which is desired and valued particularly in the case of washable textile articles or laundry. In the case of washable articles or items which are particularly difficult to handle, the wash and rinse cycles can be alternated and may be repeated twice or even more often.

After completion of the last rinse cycle, the used rinse water is drained off and the washable articles or items are also spun, if desired. If necessary or desired, a drying cycle can now be started during which heated or warm air is preferably used. The heated or warm air is forced through the washable articles or items. A partial air flow can be directed from below, e.g. to loosen the washable articles or laundry. During such flow, the air takes up moisture, which, or course, is only possible up to a certain degree of saturation. Accordingly, the warm or drying air must be renewed either from time to time or continuously.

Heating energy can be saved if the continuous passage of fresh air through the washable articles or items is avoided. This can be achieved by allowing the air present in the casing 6 to recirculate through an air recirculation line in which a fan is connected which construction would be similar to the recirculating means 12, 13 for recirculating the wash water during the wash and rinse cycles. Even more advantageous of the use of the recrculation conduit or pipe 12 which is already available for this purpose and whereby the problem of heating could be solved by utilizing the available heaters 14 or 15. The recirculation pump 13 still could pose a problem which, however, could be eliminated, for example, by a by-pass line containing a fan.

There is, however, an even better solution. The recirculation pump 13 can be constructed such that it operates at a much higher rotational speed for pumping the warm or drying air as compared to the rotational speed of this pump for pumping water. The recirculation pump 13 thus functions as a fan and is suitable for infeeding the warm or drying air.

With increasing saturation of the warm or drying air with moisture, the drying effect continuously deteriorates. To avoid such a drop in drying effectiveness, the moist air is vented, for example, after a predetermined time period and, if desired, after a short rinse cycle is replaced by fresh air which is heated as it passes through the recirculation conduit or pipe 12.

In an advantageous variation, all or at least part of the moist warm or drying air flows through the further heat exchanger 27 and is vented to the surrounding atmosphere as indicated by the arrows 28. The vented air is replaced by fresh air which flows through a pipe or fresh air inlet means 29A to the further heat exchanger 27 and, after being heated therein, is passed through a pipe or warm air outlet means 30 to the recirculation conduit or pipe 12.

In an additional possibility for obtaining warm or drying air the recirculating moist air, similar to an air conditioner, is directed past the artificially cooled surfaces of an additional heat exchanger or a cooling section 27A of the further heat exchanger 27. The water vapor present in the air is thereby partially condensed. The condensate is drained off and no fresh air is needed for replenishment. The energy requirement for this process results, in part, in heat which can be used for the subsequent heating of the air, which is particularly advantageous for large washing machines. If required, the cooling section 27A in the further heat exchanger 27 is followed by a heating section 27B for generating the warm air required for the drying operation.

Also during the drying cycle the drum 1 is rotated either continuously or intermittently.

Since water is no longer present in the washing machine and the recirculation pump 13 pumps the warm or drying air, a strong air stream can be taken from the air flow and directed such as to impinge onto the impeller 33 through the rotary drive means 1B. Such air stream is adequate to rotate the drum 1 together with the washable articles or items slowly but at any rate sufficiently. Thus a single rotary drive means 1B is adquate to run the washing machine.

The aforedescribed washing process or operation can be varied and combined in its individual phases practically as desired. By pressing various buttons, an electronic program can be selected to adapt the washing process or operation to the type and sensitivity, the degree of soiling, etc. of the washable articles or items, particularly washable textile articles or laundry. Such program simultaneously controls the rotation of the drum 1, the change or repetition of individual cycles, the replenishment of wash or rinse water or air, the change of detergent dose, the activation and measuring of heating and the like.

The construction of the inventive washing machine described hereinbefore permits the mesh cage 2 to be loaded externally of the washing machine and to be placed in a separate container filled with water for soaking. Of course, this could also be accomplished within the washing machine by filling the casing 6 with water according to the first step of the prewash cycle. Soaking shortens the wash time required for the washing machine, in particular the prewash cycle, which in some cases can be eliminated altogether, whereby wear and tear on the washable articles or items can be reduced even further. It is of advantage to soak the washable articles or items during the day and to carry out the actual washing process or operation during the night when the cost of electricity is lower.

If the washing machine is used frequently, as is the case, for example, in laundries, it is then useful to use two mesh cages 2. While the washable articles or laundry is being washed in one of the mesh cages 2, the washable articles or laundry is soaking in the other, and so on. Thus the wash cycles can follow each other more quickly and there is hardly sufficient time to warm up the fresh water in the heat exchanger 19. Especially for this case, but also generally, it is advantageous for low energy consumption during the wash cycle, to use the entire electric power available and to store it as available heat in the heat exchanger 19 which serves as a boiler.

While there are shown and described present preferred embodiments of the invention, it is to be distinctly understood that the invention is not limited thereto, but may be otherwise variously embodied and practiced within the scope of the following claims. Accordingly,

What I claim is:

1. A washing machine for washing washable articles, particularly washable textile articles, comprising:

a rotatable drum defining an axis;

rotary drive means for rotating said rotatable drum about said axis;

a casing surrounding said rotatable drum;

said rotatable drum being provided with circumferentially distributed passage openings;

holding means for receiving and holding in place said washable articles in said rotatable drum during operation of the washing machine;

means for passing at least washing liquid through said passage openings of said rotatable drum in a direction approximately normal to said axis of said rotatable drum;

said casing having an inlet and an outlet; and recirculation means containing a recirculation pump and a recirculation conduit interconnecting said outlet and said inlet of said casing for recirculating at least said washing liquid during operation of the washing machine.

2. The washing machine as defined in claim 1, wherein:

said rotatable drum is continuously rotatable under the action of said rotary drive means.

3. The washing machine as defined in claim 1, wherein:

said rotatable drum is intermittently driven for rotation through a predeterminate rotational angle under the action of said rotary drive means.

4. The washing machine as defined in claim 3, wherein:

said rotatable drum is intermittently driven for rotation through said predeterminate rotational angle which amounts to at least about 90°.

5. The washing machine as defined in claim 1, wherein:

said holding means are detachably mounted at said rotatable drum.

6. The washing machine as defined in claim 5, wherein:

said holding means comprise a mesh cage in which the washable articles are stacked in layers which extend substantially parallel to each other and to said axis of said rotatable drum.

7. The washing machine as defined in claim 6, wherein:

adjacent ones of said layers of stacked washable articles are separated by an open space.

8. The washing machine as defined in claim 1, further including:

a drain pipe connected to said recirculation conduit and provided with a relief valve; and a coarse filter preceding said relief valve in said drain pipe as seen in a predetermined throughflow direction through said drain pipe.

9. The washing machine as defined in claim 1, further including:

a fresh water feed pipe;

a heat exchanger connected to said fresh water feed pipe for at least partially heating the fresh water passed through said fresh water feed pipe; and said heat exchanger receiving waste washing liquid which has passed through said washable articles and is in heat exchange relationship with said fresh water passed through said fresh water feed pipe into said heat exchanger.

10. The washing machine as defined in claim 9, further including:

external heating means operatively associated with said heat exchanger.

11. The washing machine as defined in claim 10, wherein:

said external heating means comprise electrical heating means.

12. The washing machine as defined in claim 9, further including:

a detergent dispenser;

said fresh water feed pipe containing a branch line branching off from said fresh water feed pipe at a location preceding said heat exchanger; and said branch line being connected to said detergent dispenser for passing fresh water through said detergent dispenser to said rotatable drum.

13. The washing machine as defined in claim 1, further including:

drying means for drying said washable articles held in place in said rotatable drum after a washing operation; and said drying means comprising warm air generating means and means for passing warm air generated by said warm air generating means through said washable articles held in said rotatable drum.

14. The washing machine as defined in claim 13, wherein:

said warm air generating means comprise a further heat exchanger receiving warm air which has passed through said washable articles;

fresh air inlet means connected to said further heat exchanger; and said further heat exchanger providing heat exchange between fresh air passed through said fresh air inlet means and said warm air which has passed through said washable articles.

15. The washing machine as defined in claim 13, wherein:

said warm air generating means comprise a further heat exchanger;

a recirculation pipe; and said further heat exchanger having a warm air outlet means connected to said recirculation pipe for recirculating warm air in a closed system.

16. The washing machine as defined in claim 15, wherein:

said recirculation pipe constitutes said recirculation conduit interconnecting said outlet and said inlet of said casing.

17. The washing machine as defined in claim 16, wherein:

said recirculation pump in said recirculation conduit of said recirculation means having a first operating speed for recirculating said washing liquid and a second operating speed for recirculating said warm air and which second operating speed is greater than said first operating speed.

18. The washing machine as defined in claim 15, wherein:

said further heat exchanger comprises a cooling section for condensing water vapors from said warm air which has passed through said washable articles held in said rotatable drum; and said further heat exchanger comprising a heating section series arranged with respect to said cooling section for reheating air which has passed through said cooling section.

19. The washing machine as defined in claim 1, further including:

a heater arranged in said recirculation means.

20. The washing machine as defined in claim 19, wherein:

said recirculation pump of said recirculation means comprise a casing;

said casing is provided with a throughflow channel; and an additional heater arranged in said recirculation pump and extending around said throughflow channel.

21. The washing machine as defined in claim 1, further including:

said rotary drive means for rotating said rotatable drum comprise an impeller;

said impeller being arranged coaxially with respect to said rotatable drum and being connected to said rotatable drum; and said rotary drive means comprising means for directing a drive fluid to said impeller.

22. The washing machine as defined in claim 21, wherein:

said means for directing said drive fluid to said impeller comprise said recirculation pump of said recirculation means; and said drive fluid comprises said washing liquid.

23. The washing machine as defined in claim 1, further including:

said casing defining a highest location;

a fresh water feed pipe; and said fresh water feed pipe being connected to said casing in close proximity to said highest location of said casing in order to supply fresh water from above.

24. The washing machine as defined in claim 1, further including:

a detergent dispenser arranged in said casing.

25. The washing machine as defined in claim 24, further including:

a fresh water inlet connected to said detergent dispenser for passing fresh water through said detergent dispenser to said rotatable drum.

26. The washing machine as defined in claim 1, wherein:

said rotatable drum being rotatably mounted within said casing in a circumferentially spaced relationship to said casing;

said casing and said rotatable drum defining an intermediate space;

at least one partition subdividing said intermediate space;

said inlet and said outlet of said casing being arranged on opposite sides of said at least one partition and defining a connecting line between said inlet and said outlet;

said holding means comprising a mesh cage mounted inside said rotatable drum;

said mesh cage being subdivided by substantially parallel mesh divider walls and holding stacked layers of washable articles in adjacent parallel relationship; and said mesh divider walls extending substantially normally to said connecting line between said inlet and said outlet of said casing.

27. The washing machine as defined in claim 26, wherein:

said outlet is located substantially vertically above said inlet; and said at least one partition and said mesh divider walls extending substantially in horizontal direction.

28. The washing machine as defined in claim 26, wherein:

each said mesh divider wall comprises two mesh divider walls with an open space therebetween.

29. The washing machine as defined in claim 1, further including:

a program control selectively controlling the operation of the washing machine through predetermined operating cycles; and said program control controlling the operation of said rotary drive means for driving said rotatable drum through predetermined rotational movements during said predetermined operating cycles of the operation of the washing machine.

30. The washing machine as defined in claim 29, further including:

a controllable detergent dispenser; and said controllable detergent dispenser being controlled by means of said program control.

31. The washing machine as defined in claim 29, further including:

fresh water feed means;

controllable heating means operatively associated with said fresh water feed means and said recirculation means; and said controllable heating means being controlled by means of said program control.

32. The washing machine as defined in claim 29, further including:

drying means for drying said washable articles held in place in said rotatable drum, after a washing operation;

said drying means comprising warm air generating means generating warm air for drying said washable articles held in place in said rotatable drum and containing controllable heating means; and said program control controlling the operation of said controllable heating means and said rotary drive means for driving said rotatable drum through predeterminate rotational movements during said predetermined operating cycles of the operation of the washing machine.

* * * * *

UNITED STATES PATENT AND TRADEMARK OFFICE

CERTIFICATE OF CORRECTION

PATENT NO. : 4,727,733

DATED : March 1, 1988

INVENTOR(S) : JAKOB HUBER

It is certified that error appears in the above-identified patent and that said Letters Patent is hereby corrected as shown below:

Column 1, line 19, after "present" please insert --time--

Column 1, line 33, please delete "a" (first occurrence)

Column 2, line 28, please delete "expendicture" and insert --expenditure--

Column 4, line 26, please delete "wall" and insert --walls--

Column 5, line 30, after "drum" please insert --1--

Column 5, line 62, after "water" please insert --or used wash water or liquid--

Column 6, line 44, after "curves" please insert --are--

Column 7, line 36, after "the" please delete "casting" and insert --casing--

Column 7, line 54, after "1" please insert --by--

Column 6, line 43, after "curves" delete "are".

Signed and Sealed this

Thirteenth Day of September, 1988

*Attest:*

DONALD J. QUIGG

*Attesting Officer*

*Commissioner of Patents and Trademarks*